US007437795B1

(12) United States Patent
Bez

(10) Patent No.: US 7,437,795 B1
(45) Date of Patent: Oct. 21, 2008

(54) MOP BUCKET ASSEMBLY

(76) Inventor: Kris Bez, 24 S. Maryland Ave., Port Washington, NY (US) 11050

( * ) Notice: Subject to any disclaimer, the term of this patent is extended or adjusted under 35 U.S.C. 154(b) by 0 days.

(21) Appl. No.: 11/891,260

(22) Filed: Aug. 9, 2007

(51) Int. Cl.
*A47L 13/14* (2006.01)
*A47L 13/58* (2006.01)

(52) U.S. Cl. ..... 15/261; 15/260; 15/264

(58) Field of Classification Search ..... 15/260, 15/261, 264
See application file for complete search history.

(56) References Cited

U.S. PATENT DOCUMENTS

| | | | | |
|---|---|---|---|---|
| 4,713,859 | A | 12/1987 | Smith, Jr. | |
| 4,751,763 | A | 6/1988 | Rose et al. | |
| 5,627,150 | A | 5/1997 | Peterson et al. | |
| 6,006,397 | A * | 12/1999 | Williams et al. | 15/261 |
| 6,279,195 | B1 | 8/2001 | Biggs | |
| 6,457,203 | B1 | 10/2002 | Williams et al. | |
| 6,560,815 | B1 | 5/2003 | Brennan et al. | |
| 2005/0076465 | A1 | 4/2005 | Rousey | |
| 2005/0086760 | A1 | 4/2005 | Young | |
| 2007/0022559 | A1 | 2/2007 | Dalton | |

* cited by examiner

*Primary Examiner*—Randall Chin
(74) *Attorney, Agent, or Firm*—Collard & Roe, P.C.

(57) ABSTRACT

A mop bucket assembly for use with a wringer device and a mop includes a container having partition elements dividing the container into compartments. A first compartment contains a liquid for rinsing the mop head after mopping. A second compartment receives a liquid extracted from the mop head by the wringer device. A fourth compartment contains a cleaning solution. A housing is received in a third compartment and a flexible bladder is disposed in the housing and is in fluid communication with the fourth compartment. The flexible bladder contains a supply of cleaning solution. Liquid extracted from the mop head by the wringer device flows through an opening in one of the partition elements and places pressure on the flexible bladder, causing the cleaning solution in the flexible bladder to flow into the fourth compartment to maintain a desired level of cleaning solution in the fourth compartment.

14 Claims, 5 Drawing Sheets

MOP BUCKET ASSEMBLY

BACKGROUND OF THE INVENTION

1. Field of the Invention

The invention relates to a mop bucket assembly for use with a wringer device and a mop. In particular, the invention relates to a mop bucket assembly including a container having multiple compartments and a flexible bladder for storing and dispensing a cleaning solution.

2. The Prior Art

The following references, the disclosures of which are incorporated herein by reference, relate to various mop bucket assemblies. U.S. Patent Application Publication No. 2007/0022559 to Dalton shows a mop bucket bag insert which can be used to capture dirty excess water and/or clean water during the mopping process. U.S. Pat. No. 6,560,815 to Brennan et al. shows a mop squeezing device including a dedicated bucket or bucket insert divided longitudinally into two compartments.

U.S. Patent Application Publication No. 2005/0086760 to Young shows a multi-compartment cleaning bucket having a partition element dividing the bucket into a first compartment for receiving liquid wrung out from a wringer and a second compartment for receiving a cleaning liquid. A dirt receiving element or filter is disposed in the first compartment for receiving dirt settling from the cleaning liquid in the second compartment.

U.S. Patent Application Publication No. 2005/0076465 to Rousey shows a mop bucket filtering system including a dual basin bucket with an exteriorly mounted pump and filter. U.S. Pat. No. 4,751,763 to Rose et al. shows a mop bucket insert including a platform suspended above the bottom of the bucket which provides a surface for applying the mop to remove solids from the mop head. The solids settle into the lower portion of the bucket below the platform, preventing suspension of the solids in the cleaning liquid when the mop agitates the liquid.

U.S. Pat. No. 4,713,859 to Smith, Jr. shows a bucket assembly with a drain opening formed in the lowermost portion of the bucket, a valve assembly for selectively opening and closing the drain and a movable filter element for removing insoluble debris from the discharged liquid.

U.S. Pat. No. 6,279,195 to Biggs shows an ergonomic mop bucket including a foot operated wringer, a drain mechanism and a filter element positioned between the front and rear of the bucket to inhibit the travel of suspended particulates from the area where the mop head is wrung out to the area where the clean fluid is contained.

In addition to the above mentioned references, U.S. Pat. No. 5,627,150 to Peterson et al. shows a container for dispensing solid chemicals such as detergents. The container includes a plastic bladder within a paperboard housing.

SUMMARY OF THE INVENTION

The invention relates to a mop bucket assembly for use with a wringer device and a mop having a mop head.

A mop bucket assembly according to an embodiment of the invention includes a container having a plurality of partition elements disposed therein. The plurality of partition elements divide the container into a plurality of compartments. A flexible bladder for containing a supply of cleaning solution is disposed in one the compartments. A liquid extracted from the mop head by the wringer device places pressure on an outer surface of the flexible bladder, causing the cleaning solution in the flexible bladder to flow into another of the compartments.

A mop bucket assembly according to another embodiment of the invention includes a container and a plurality of partition elements disposed within the container. The plurality of partition elements divide the container into a plurality of compartments including a first compartment for containing a liquid for rinsing the mop head after mopping, a second compartment for receiving a liquid extracted from the mop head by the wringer device, a third compartment, and a fourth compartment for containing a cleaning solution.

A housing is adapted to be received in the third compartment and a flexible bladder for containing a supply of the cleaning solution is disposed in the housing. The flexible bladder is in fluid communication with the fourth compartment.

The liquid extracted from the mop head by the wringer device flows through an opening in one of the plurality of partition elements disposed between the second and third compartments and places pressure on an outer surface of the flexible bladder. This pressure causes the cleaning solution in the flexible bladder to flow into the fourth compartment to maintain a desired level of cleaning solution in the fourth compartment.

According to a further embodiment of the invention, a spring biased valve is disposed between the flexible bladder and the fourth compartment. The spring biased valve may be movable between an open position when the flexible bladder and housing are disposed in the third compartment and a closed position when the flexible bladder and housing are lifted out of the third compartment of the container.

An advantage of a mop bucket assembly according to an embodiment of the invention is that a constant, fresh supply of cleaning solution may be provided to the compartment or chamber into which the mop head is wetted for cleaning a floor or other surface. A further advantage of a mop bucket assembly according to an embodiment of the invention is that the pressure exerted by the dirty water extracted from the mop head on the flexible bladder can maintain a substantially constant level of cleaning solution in the cleaning solution compartment.

Another advantage of a mop bucket assembly according to an embodiment of the invention is that the dirty water extracted from the mop head is segregated from the cleaning solution used to mop the floor or other surface.

A mop bucket assembly according to an embodiment of the invention may also have the advantage of including a spring biased valve which automatically closes when a flexible bladder and housing are lifted out of the container and automatically opens when the flexible bladder and housing are seated in the container.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
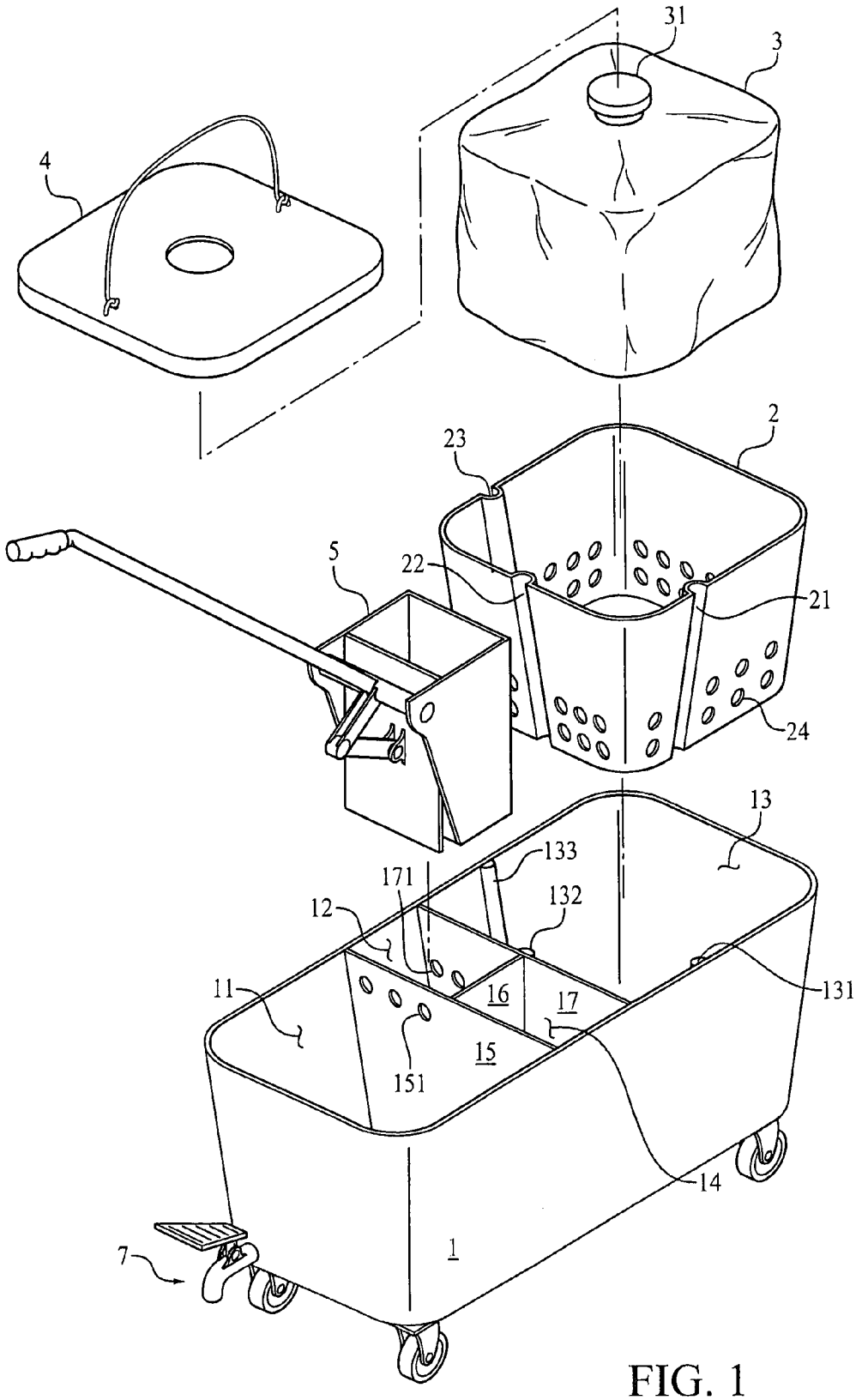
FIG. 1 shows a top perspective view of a mop bucket assembly according to an embodiment of the invention.
Figure 2:
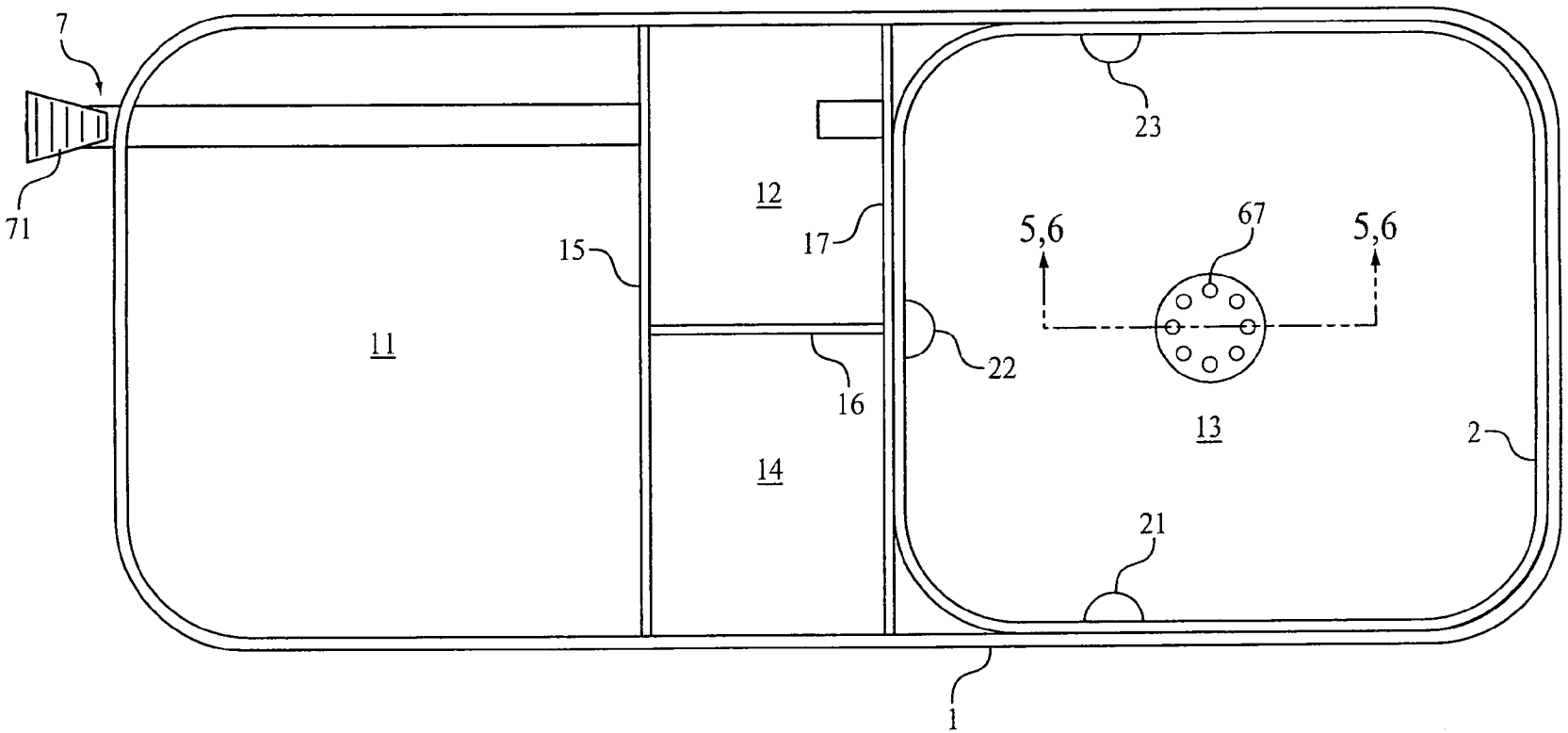
FIG. 2 shows a top view of a mop bucket assembly according to an embodiment of the invention.

Referring now in detail to the drawings and, in particular, FIG. 1 shows a top perspective view of a mop bucket assembly for use with a wringer device 5 and a mop having a mop head (not shown). The assembly includes a container 1. Container 1 may be similar in dimensions and shape to conventional mop buckets and may be formed from metal, plastic or any other suitable water tight material or materials. For example, container 1 may have a generally rectangular shape. Wheels or casters may be provided on or near the underside of container 1 to allow container 1 to be easily moved by rolling container 1 along a floor surface.

Container 1 includes a plurality of partition elements 15, 16, 17 disposed within the container. Partition elements 15, 15, 17 may comprise for example, rigid walls extending upwardly from a bottom inside surface of container 1 to at or about an upper edge of container 1 as shown.

The partition elements divide container 1 into a plurality of compartments or chambers. For example, partition elements 15 and 17 may extend between opposing sides of container 1 and partition element 16 may extend between partition elements 15 and 17, thereby forming four compartments 11, 12, 13 and 14 wherein each compartment is defined by one or more of the partition elements and one or more side walls of container 1.

The plurality of compartments may include a first compartment 11 for containing a liquid, such as water, for rinsing the mop head after mopping. A second compartment 12 is adapted to accept a wringer device 5 for removing dirty liquid from the mop head after mopping a surface. Wringer 5 may be supported on an upper portion of second compartment 12, for example on a top portion of the partition element(s) and/or container wall(s). The dirty mop head is inserted into wringer 5, and wringer 5 is actuated using a handle. The mop head is squeezed between the wringer plates and the dirty liquid is extracted from the mop head and drains out the bottom of wringer 5, for example through openings in the wringer basket. Second compartment 12 receives the liquid extracted from the mop head by wringer device 5.

Figure 3:
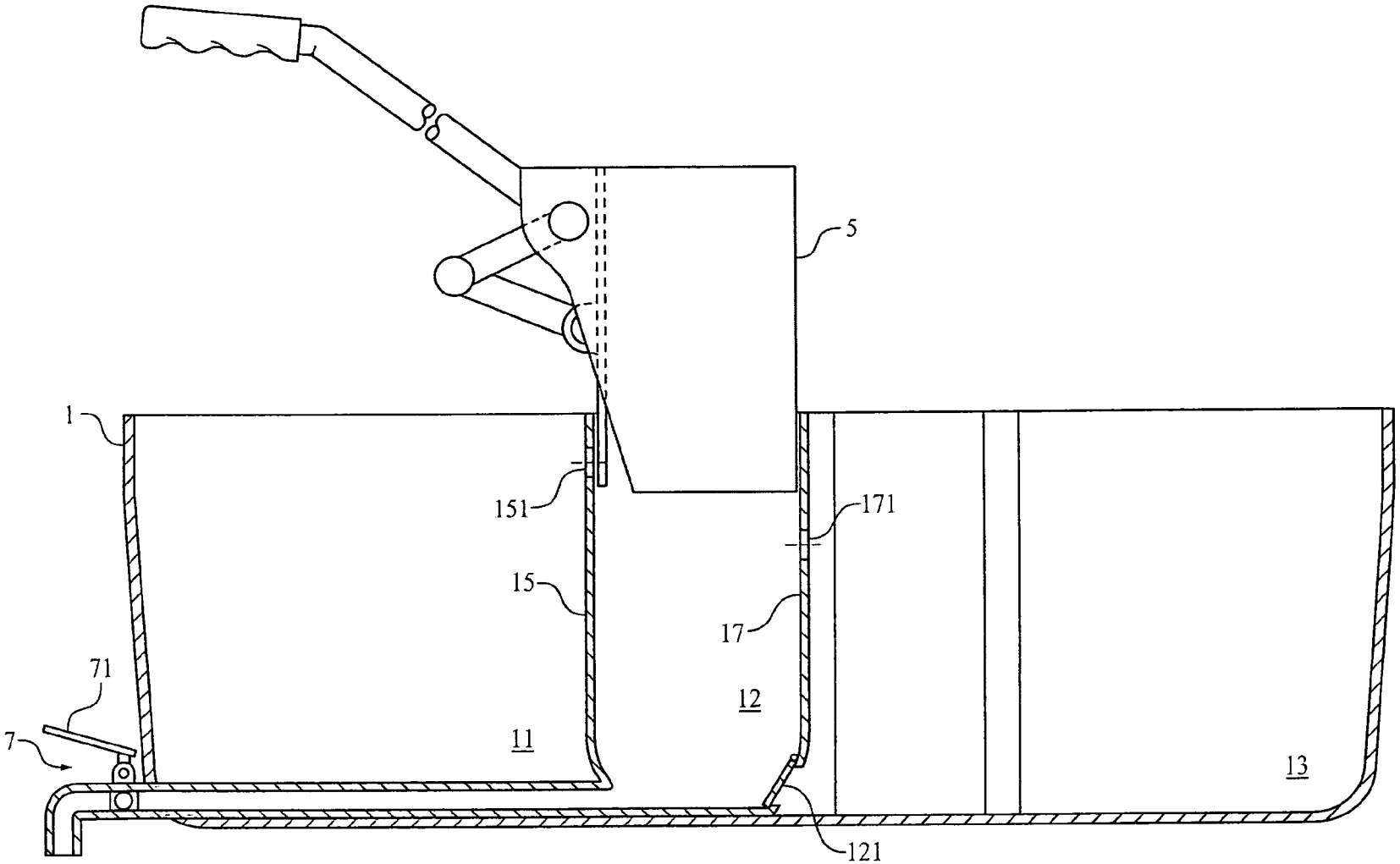
FIG. 3 shows a cross section of a mop bucket assembly according to an embodiment of the invention.

As shown in FIGS. 1 and 3, wringer device 5 may include a handle portion which is configured such that a user grasps a grip portion of the handle and pushes in a generally downward direction to squeeze the liquid from the mop head and pulls in a generally upward direction to release the mop head from the wringer 5. This handle design facilitates operation of the wringer 5 and reduces user fatigue from repeated operation of the wringer 5.

Container 1 may further include a third compartment 13. As shown, third compartment 13 is defined by partition element 17 along with the associated walls of container 1. A fourth compartment 14 may also be provided in container 1 for containing a cleaning solution. The cleaning solution is a liquid, for example water, and may include any of various cleaners, detergents, soaps or other compositions to be applied to the surface being mopped. In use, the mop head is dipped in the fourth compartment or cleaning solution reservoir 14 and wetted with the cleaning solution prior to mopping the floor or surface to be cleaned.

The mop bucket assembly may include a housing 2 which is adapted to be received in the third compartment 13. Housing 2 may include a plurality of recesses 21, 22, 23 and third compartment 13 may include a plurality of corresponding projections 131, 132, 133 which are aligned with the recesses in the housing. When housing 3 is inserted into third compartment 13 of container 1, the corresponding projections and recesses function to properly locate and seat housing 3 into third compartment 13. In particular, this proper seating of housing 3 contributes to the proper functioning of valve mechanism 6, as described herein.

A flexible bladder 3 is disposed within one of the compartments of the mop bucket assembly. For example, flexible bladder 3 may be disposed within housing 2 which is received in third compartment 13. Alternatively, flexible bladder 3 may be disposed directly in one of the container compartments without using a housing. Flexible bladder 3 may be formed from a flexible, water tight material, for example a plastic or rubber material.

As shown in FIG. 1, a housing cover 4 having a handle may be provided. Housing cover 4 is configured to fit securely over housing 2 and in combination with the housing cover handle may be used for lifting housing 2 and flexible bladder 3 out of a respective container compartment.

Flexible bladder 4 contains a supply of the cleaning solution to be supplied to a separate container compartment for dipping the mop head. To facilitate the filling of flexible bladder 3 with a supply of cleaning solution, a removable cap 31 may be provided. Removable cap 31 may be threaded, snapped or otherwise coupled to flexible bladder 3 so that cap 31 may be readily removed for filling of bladder 3 and replaced once bladder 3 is filled.

Figure 4:
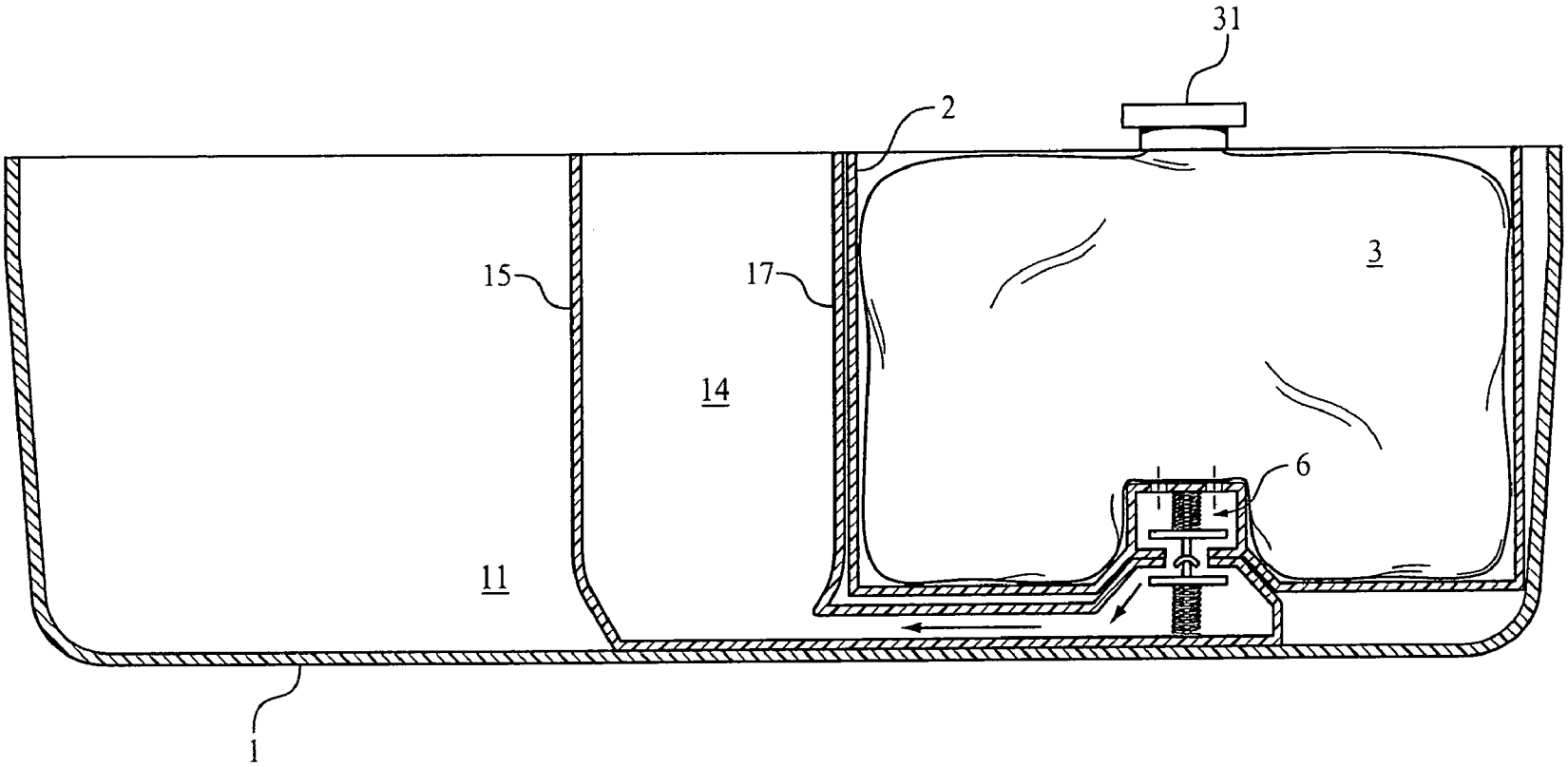
FIG. 4 shows another cross section of a mop bucket assembly according to an embodiment of the invention.

As shown, for example in cross section in FIG. 4, flexible bladder 4 is in fluid communication with a compartment for holding the cleaning solution, for example fourth compartment 14. This fluid communication between the flexible bladder 3 and container compartment may be provided, for example, by a channel or passage formed in the container body, or a tube extending between the flexible bladder 3 and the respective compartment for containing the cleaning solution.

In use, the dirty liquid extracted from the mop head by the wringer device 5 flows through one or more an openings in one of the partition elements disposed between the compartment in which the wringer is situated and the compartment in which the flexible bladder is situated. For example, as shown in FIGS. 1 and 3, dirty liquid extracted from the mop head be wringer 5 may flow from second compartment 12 to third compartment 13 thorough opening 171 in partition 17 between the second and third compartments.

The liquid extracted from the mop head places pressure on an outer surface of flexible bladder 4, causing the cleaning solution in the flexible bladder to flow into another compartment, for example fourth compartment 14. In this way, a constant, fresh supply of cleaning solution may be provided to the compartment or chamber into which the mop head is wetted for cleaning a floor or other surface. The pressure exerted by the dirty water extracted from the mop head on the flexible bladder can maintain a substantially constant level of cleaning solution in the cleaning solution compartment. The above-described configuration also has the advantage of segregating the dirty water extracted from the mop head from the cleaning solution used to mop the floor or other surface.

When housing 2 is used in combination with flexible bladder 3, housing 1 may include one or more openings 24 for allowing the liquid extracted from the mop head to flow around the flexible bladder 3.

Container 1 may further include a drain valve for draining the liquid from one or more of the compartments, for example second compartment 12. Drain valve 7 may be located at a lower portion of container 1 and may comprise any of various types of valves known in the art, such as a globe valve, gate valve, butterfly valve, ball valve or the like. Drain valve 7 is preferably designed to allow rapid draining of liquid from container 1. In use, container 1 may be positioned such that drain valve 7 is positioned over a floor drain and drain valve 7 is opened to drain liquid from container 1, in particular the dirty liquid from second compartment 12 and third compartment 13. Drain valve 7 may further comprise a foot actuated drain valve which is operable by depressing a foot pedal 71 with a user's foot.

As shown in FIG. 3, a back flow prevention flap 121 may be disposed between second compartment 12 and said third compartment 13. The back flow prevention flap 121 is for the preventing the dirty liquid extracted from the mop head by wringer device 5 from flowing from a lower portion of second compartment 12 into third compartment 13 and/or housing 3. When drain valve 7 is opened and dirty liquid is drained from second compartment 12, the back flow prevention flap 121 may open, allowing the dirty liquid in the third compartment 13 and housing 2 to drain out through drain valve 7.

One or more overflow openings 151 may be provided in the partition element disposed between the compartment in which the wringer is to be situated, for example second compartment 12, and the compartment for containing the liquid for rinsing the mop head after mopping, for example first compartment 11. Overflow openings allow excess liquid extracted from the mop head to flow from the wringer compartment to the rinse compartment to prevent overflowing of the container. Preferably, any overflow openings 151 are positioned at a greater height than the opening or openings 171 in the partition separating the wringer compartment 12 from the compartment 13 in which the flexible bladder 14 is disposed, as shown for example in FIG. 3.

Figure 5:
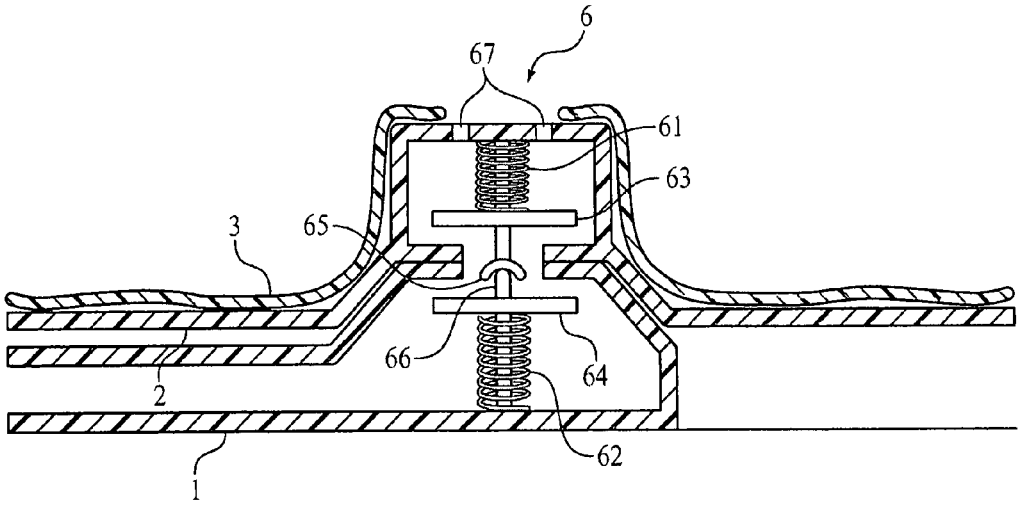
FIG. 5 shows a detailed view of a valve for a mop bucket assembly according to an embodiment of the invention, wherein the valve is in an open position.
Figure 6:
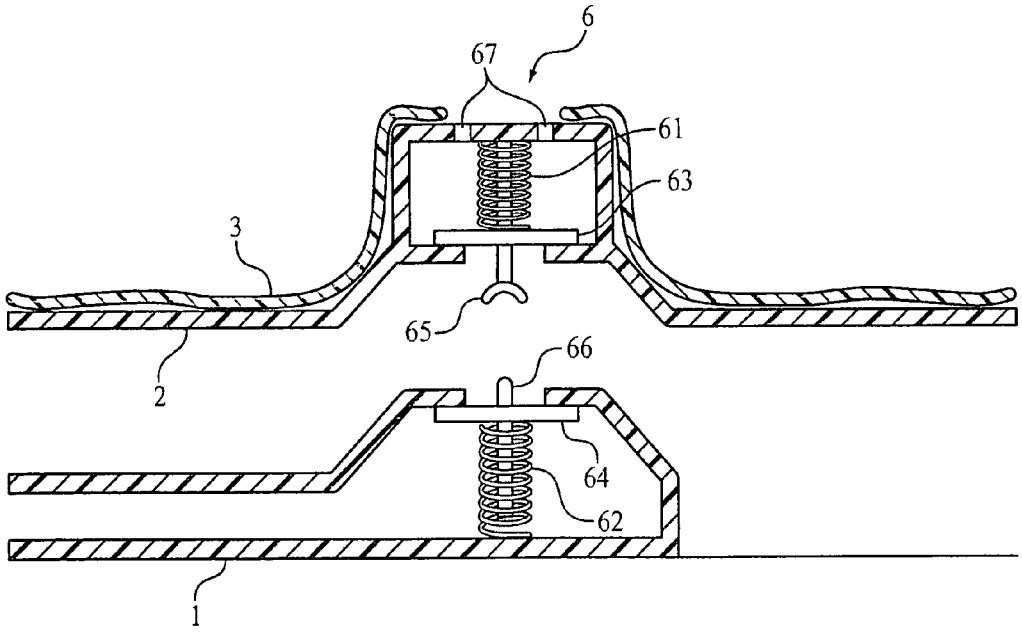
FIG. 6 shows a detailed view of a valve for a mop bucket assembly according to an embodiment of the invention, wherein the valve is in a closed position.

As shown in FIG. 4 and in greater detail in FIGS. 5 and 6, a spring biased valve mechanism 6 may be disposed between the flexible bladder 4 and the compartment for containing the cleaning solution for wetting the mop head, such as fourth compartment 14. Spring biased valve may be movable between an open position when flexible bladder 3 and housing 2 are disposed in container 1 (FIG. 5) and a closed position when flexible bladder 3 and housing 2 are lifted out of container 1 (FIG. 6). In the open position, cleaning solution is permitted to freely flow between flexible bladder 3 and fourth compartment 14. In the closed position, the spring biased valve seals the opening between the flexible bladder 3 and the container compartment to which the bladder is coupled. As shown in FIGS. 5 and 6, spring biased valve 6 may include a first sealing face 63 and a second sealing face 64. First sealing face 63 is biased downwardly by a first spring 61 and second sealing face 64 is biased upwardly by a second spring 62.

When flexible bladder 3 and housing 2 are inserted into the container 1 compartment, a downwardly projecting member 65 of an upper portion of spring biased valve mechanism 6 contacts an upwardly projecting member 66 of a lower portion of spring biased valve mechanism 66. The engagement of the members 65 and 66 pushes first sealing face 63 upward against first spring 61 and second sealing face 64 downward against second spring 62, opening valve 6 as shown in FIG. 5. This movement permits cleaning solution to freely flow from flexible bladder 3 through openings 67 and into container compartment 14 through a connecting channel, passage or tube.

Preferably, member 65 has a curved shape to facilitate its engagement with member 66. Additionally, recesses 21, 22, 23 of housing 2 and corresponding protrusions 131, 132, 133 of compartment 13 may function to properly seat the components of spring biased valve 6 by accurately locating housing 2 in compartment 13.

When housing 2 and flexible bladder 3 are lifted out of the container compartment, for example to fill flexible bladder 3 with cleaning solution, first spring 61 pushes downward on first sealing face 63 and second spring 62 pushes upward on second sealing face 64. This movement seals the openings between the flexible bladder 3 and compartment 14 as shown in FIG. 6 and prevents liquid from flowing out of the flexible bladder. Thus, in operation spring biased valve 6 automatically closes when flexible bladder 3 and housing 2 are lifted out of container 1 and automatically opens when flexible bladder 3 and housing 2 are seated in container 1.

Accordingly, while several embodiments of the present invention have been shown and described, it is obvious that many changes and modifications may be made thereunto without departing from the spirit and scope of the invention.

What is claimed is:

1. A mop bucket assembly comprising:

a) a container;

b) a plurality of partition elements disposed within said container, said plurality of partition elements dividing said container into a plurality of compartments; said plurality of compartments comprising:

i) a first compartment for containing a rinsing liquid;

ii) a second compartment for receiving an extracted liquid;

iii) a third compartment; and iv) a fourth compartment for containing a cleaning solution;

c) a housing adapted to be received in said third compartment; and d) a flexible bladder disposed in said housing and in fluid communication with said fourth compartment, said flexible bladder for containing a supply of the cleaning solution;

wherein the extracted liquid through an opening in one of said plurality of partition elements disposed between said second compartment and said third compartment and places pressure on an outer surface of said flexible bladder, causing the cleaning solution in said flexible bladder to flow into said fourth compartment to maintain a desired level of cleaning solution in said fourth compartment.

2. The mop bucket assembly according to claim 1, further comprising a spring biased valve disposed between said flexible bladder and said fourth compartment.

3. The mop bucket assembly according to claim 2, wherein said spring biased valve is movable between an open position when said flexible bladder and said housing are disposed in said third compartment of said container and a closed position when said flexible bladder and said housing are lifted out of said third compartment of said container.

4. The mop bucket assembly according to claim 3, wherein said spring biased valve comprises a first sealing face biased downwardly by a first spring and a second sealing face biased upwardly by a second spring.

5. The mop bucket assembly according to claim 1, further comprising a drain valve for draining the liquid from said second compartment of said container.

6. The mop bucket assembly according to claim 5, wherein said drain valve is a foot actuated drain valve.

7. The mop bucket assembly according to claim 1, further comprising a back flow prevention flap disposed between said second compartment and said third compartment.

8. The mop bucket assembly according to claim 1, wherein said third compartment comprises a plurality of protrusions and said housing comprises a plurality of corresponding recesses for locating said housing in said third compartment.

9. The mop bucket assembly according to claim 1, wherein said housing comprises a plurality of openings.

10. The mop bucket assembly according to claim 1, wherein a partition element of said plurality of partition elements disposed between said first compartment and said second compartment has an overflow opening.

11. The mop bucket assembly according to claim 1, further comprising a housing cover having a handle for lifting said housing and said flexible bladder out of said third compartment.

12. The mop bucket assembly according to claim 1, wherein said flexible bladder further comprises a removable cap for filling said flexible bladder with the supply of cleaning solution.

13. A mop bucket assembly comprising:

a) a container;

b) a plurality of partition elements disposed within said container, said plurality of partition elements dividing said container into a plurality of compartments; and c) a flexible bladder disposed in one of said plurality of compartments, said flexible bladder for containing a supply of cleaning solution;

wherein an extracted liquid places pressure on an outer surface of said flexible bladder, causing the cleaning solution in said flexible bladder to flow into another of said plurality of compartments.

14. A cleaning apparatus comprising:

a) a mop having a mop head;

b) a wringer device;

c) a container;

d) a plurality of partition elements disposed within said container, said plurality of partition elements dividing said container into a plurality of compartments; said plurality of compartments comprising:

i) a first compartment for containing a liquid for rinsing said mop head after mopping;

ii) a second compartment for receiving a liquid extracted from said mop head by said wringer device;

iii) a third compartment; and iv) a fourth compartment for containing a cleaning solution;

e) a housing adapted to be received in said third compartment; and f) a flexible bladder disposed in said housing and in fluid communication with said fourth compartment, said flexible bladder for containing a supply of the cleaning solution;

wherein the liquid extracted from said mop head by said wringer device flows through an opening in one of said plurality of partition elements disposed between said second compartment and said third compartment and places pressure on an outer surface of said flexible bladder, causing the cleaning solution in said flexible bladder to flow into said fourth compartment to maintain a desired level of cleaning solution in said fourth compartment.

* * * * *